US012479553B1

(12) United States Patent
Andrasko et al.

(10) Patent No.: US 12,479,553 B1
(45) Date of Patent: Nov. 25, 2025

(54) PARALLEL STEERING ACTUATION SYSTEM AND METHOD FOR A MARINE VESSEL

(71) Applicant: Brunswick Corporation, Mettawa, IL (US)

(72) Inventors: Steven J. Andrasko, Oshkosh, WI (US); Matthew W. Snyder, Fond du Lac, WI (US); Andrew Sheely, Fond du Lac, WI (US); Ryan A. Fergus, Neenah, WI (US); Travis C. Malouf, Germantown, WI (US)

(73) Assignee: Brunswick Corporation, Mettawa, IL (US)

( * ) Notice: Subject to any disclaimer, the term of this patent is extended or adjusted under 35 U.S.C. 154(b) by 704 days.

(21) Appl. No.: 17/855,975

(22) Filed: Jul. 1, 2022

(51) Int. Cl.

| | |
|---|---|
| ***B63H 20/12*** | (2006.01) |
| ***B63B 79/10*** | (2020.01) |
| ***B63B 79/40*** | (2020.01) |
| ***B63H 20/00*** | (2006.01) |
| ***B63H 25/42*** | (2006.01) |

(52) U.S. Cl.
CPC ..... *B63H 20/12* (2013.01); *B63B 79/10* (2020.01); *B63B 79/40* (2020.01); *B63H 25/42* (2013.01); *B63H 2020/003* (2013.01)

(58) Field of Classification Search
CPC ..... B63H 20/12; B63H 20/08; B63H 25/42; B63H 2020/003; B63B 79/10; B63B 79/40
See application file for complete search history.

(56) References Cited

U.S. PATENT DOCUMENTS

| | | | |
|---|---|---|---|
| 6,402,577 | B1 | 6/2002 | Treinen et al. |
| 6,821,168 | B1 | 11/2004 | Fisher et al. |
| 6,913,497 | B1 | 7/2005 | Ahlswede et al. |
| 7,150,664 | B1 | 12/2006 | Uppgard et al. |
| 7,255,616 | B1 | 8/2007 | Caldwell |

(Continued)

FOREIGN PATENT DOCUMENTS

CA 2259854 A1 * 7/1999 ..... B63H 20/12

OTHER PUBLICATIONS

Valenzuela et al. "Electronic Line-Shafting Control for Paper Machine Drives", IEEE Transactions on Industry Applications, vol. 37, No. 1, published Oct. 19, 2000.

*Primary Examiner* — Anthony D Wiest
(74) *Attorney, Agent, or Firm* — Andrus Intellectual Property Law, LLP

(57) ABSTRACT

A system for steering a marine vessel includes first and second marine drives connected by a mechanical link such that they are steered in parallel, a first steering actuator configured to rotate the first marine drive and a first steering position sensor configured to measure a steering position thereof. A second steering actuator configured to rotate the second marine drive. The control system is configured to receive a steering command and a current steering position from the first steering position sensor. A first steering instruction is then determined for the first steering actuator based on the steering command and the current steering position such that the first steering actuator bears a first portion of a total steering load to effectuate the steering command. A coordinated steering instruction is determined for the second steering actuator such that the second steering actuator bears a remaining portion of the total steering load.

20 Claims, 7 Drawing Sheets

(56) References Cited

U.S. PATENT DOCUMENTS

| | | | | |
|---|---|---|---|---|
| 7,467,595 | B1 | 12/2008 | Lanyi et al. | |
| 7,527,538 | B2 | 5/2009 | Mizutani | |
| 8,046,122 | B1 | 10/2011 | Barta et al. | |
| 8,430,702 | B2 * | 4/2013 | Davidson | B63H 25/30 440/61 R |
| 8,512,085 | B1 | 8/2013 | Kobilic | |
| 9,359,057 | B1 | 6/2016 | Andrasko et al. | |
| 9,598,163 | B1 | 3/2017 | Gable et al. | |
| 9,771,137 | B1 | 9/2017 | Gable et al. | |
| 2013/0284080 | A1 * | 10/2013 | Davidson | B63H 20/12 114/150 |
| 2015/0246714 | A1 | 9/2015 | Morikami et al. | |
| 2023/0166823 | A1 * | 6/2023 | Wood | B63H 25/12 440/61 S |

* cited by examiner

PARALLEL STEERING ACTUATION SYSTEM AND METHOD FOR A MARINE VESSEL

FIELD

The present disclosure relates to methods and systems for controlling steering actuators in a marine propulsion system having a plurality of marine drives that are mechanically connected together and steered in parallel.

BACKGROUND

The following U.S. patents and patent applications are hereby incorporated herein by reference in their entireties.

U.S. Pat. No. 6,913,497 discloses a connection system for connecting two or more marine propulsion devices together. The connection system provides a coupler that can be rotated in place, without detachment from other components, to adjust the distances between the tie bar arms. In addition, the use of various clevis ends and pairs of attachment plates on the components significantly reduces the possibility of creating moments when forces and their reactions occur between the various components.

U.S. Pat. No. 7,255,616 discloses a steering system for a marine propulsion device that eliminates the need for two support pins and provides a hydraulic cylinder with a protuberance and an opening which cooperate with each other to allow a hydraulic cylinder's system to be supported by a single pin for rotation about a pivot axis. The single pin allows the hydraulic cylinder to be supported by an inner transom plate in a manner that it allows it to rotate in conformance with movement of a steering arm of a marine propulsion device.

U.S. Pat. No. 7,467,595 discloses a method for controlling the movement of a marine vessel that rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 8,046,122 discloses a control system for a hydraulic steering cylinder utilizing a supply valve and a drain valve. The supply valve is configured to supply pressurized hydraulic fluid from a pump to either of two cavities defined by the position of a piston within the hydraulic cylinder. A drain valve is configured to control the flow of hydraulic fluid away from the cavities within the hydraulic cylinder. The supply valve and the drain valve are both proportional valves in a preferred embodiment of the disclosed invention in order to allow accurate and controlled movement of a steering device in response to movement of a steering wheel of a marine vessel.

U.S. Pat. No. 8,512,085 discloses a tie bar apparatus for a marine vessel having at least first and second marine drives. The tie bar apparatus comprises a linkage that is geometrically configured to connect the first and second marine drives together so that during turning movements of the marine vessel, the first and second marine drives steer about respective first and second vertical steering axes at different angles, respectively.

U.S. Pat. No. 9,359,057 discloses a system for controlling movement of a plurality of drive units on a marine vessel having a control circuit communicatively connected to each drive unit. When the marine vessel is turning, the control circuit defines one of the drive units as an inner drive unit and another of the drive units as an outer drive unit. The control circuit calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel is turning. An absolute value of the outer drive unit steering angle is less than an absolute value of the inner drive unit steering angle.

U.S. Pat. No. 9,771,137 discloses a method of controlling steering loads on a marine propulsion system of a marine vessel. The marine vessel has at least two sets of marine drives, each set having at least an inner marine drive and an outer marine drive, and a steer-by-wire steering actuator is associated with each set of marine drives. The method includes determining a maximum required actuator pressure on each steer-by-wire steering actuator, and determining a pressure reduction amount based on the maximum required actuator pressure. A link toe angle has been determined based on the pressure reduction amount. A mechanical link connecting each inner marine drive to the respective outer marine drive is adjusted to achieve the link toe angle.

U.S. Pat. No. 9,598,163 discloses a system for steering a marine vessel that includes a first marine drive having a first engine control module and a second marine drive having a second engine control module, where the first and second marine drives are connected by a mechanical link. A first steer-by-wire steering actuator is configured to rotate the first and second marine drives to steer the marine vessel, and a first actuator control module controls the first steer-by-wire steering actuator. The system operates such that the first actuator control module activates the first steer-by-wire steering actuator if either the first marine drive or the second marine drive is running.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a system for steering a marine vessel includes a first marine drive and a second marine drive connected by a mechanical link such that they are steered in parallel, a first steering actuator configured to rotate the first marine drive about a first steering axis, a first steering position sensor configured to measure a steering position of the first marine drive, and a second steering actuator configured to rotate the second marine drive about a second steering axis. The control system is configured to receive a steering command and receive a current steering position from the first steering position sensor. A first steering instruction is then determined for the first steering actuator based on the steering command and the current steering position such that the first steering actuator bears a first portion of a total steering load to effectuate the steering command. A coordinated steering instruction is determined for the second steering actuator such that the second steering actuator bears a remaining portion of the total steering load. The first steering actuator is controlled based on the first steering instruction and the second steering actuator is controlled based on the coordinated steering instruction such that the first and second marine drives are steered in parallel.

In one embodiment, a method of controlling at least two steering actuators on a marine vessel, wherein each of the at least two steering actuators are configured to steer a respective one of at least a first marine drive and a second marine drive that are connected by a mechanical link such that they are steered in parallel, includes receiving a steering command and receiving a current steering position from a steering position sensor configured to measure a steering position of the first marine drive or the second marine drive. A first steering instruction is determined for a primary steering actuator of the at least two steering actuators based on the steering command and the steering position such that the primary steering actuator bears a first portion of a total steering load to effectuate the steering command. A coordinated steering instruction is determined for a secondary steering actuator of the at least two steering actuators such that the secondary steering actuator is a remaining portion of the total steering load. The primary steering actuator is controlled based on the first steering instruction and the secondary steering actuator controlled based on the coordinated steering instruction such that the first and second marine drives are steered in parallel about their respective steering axes.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
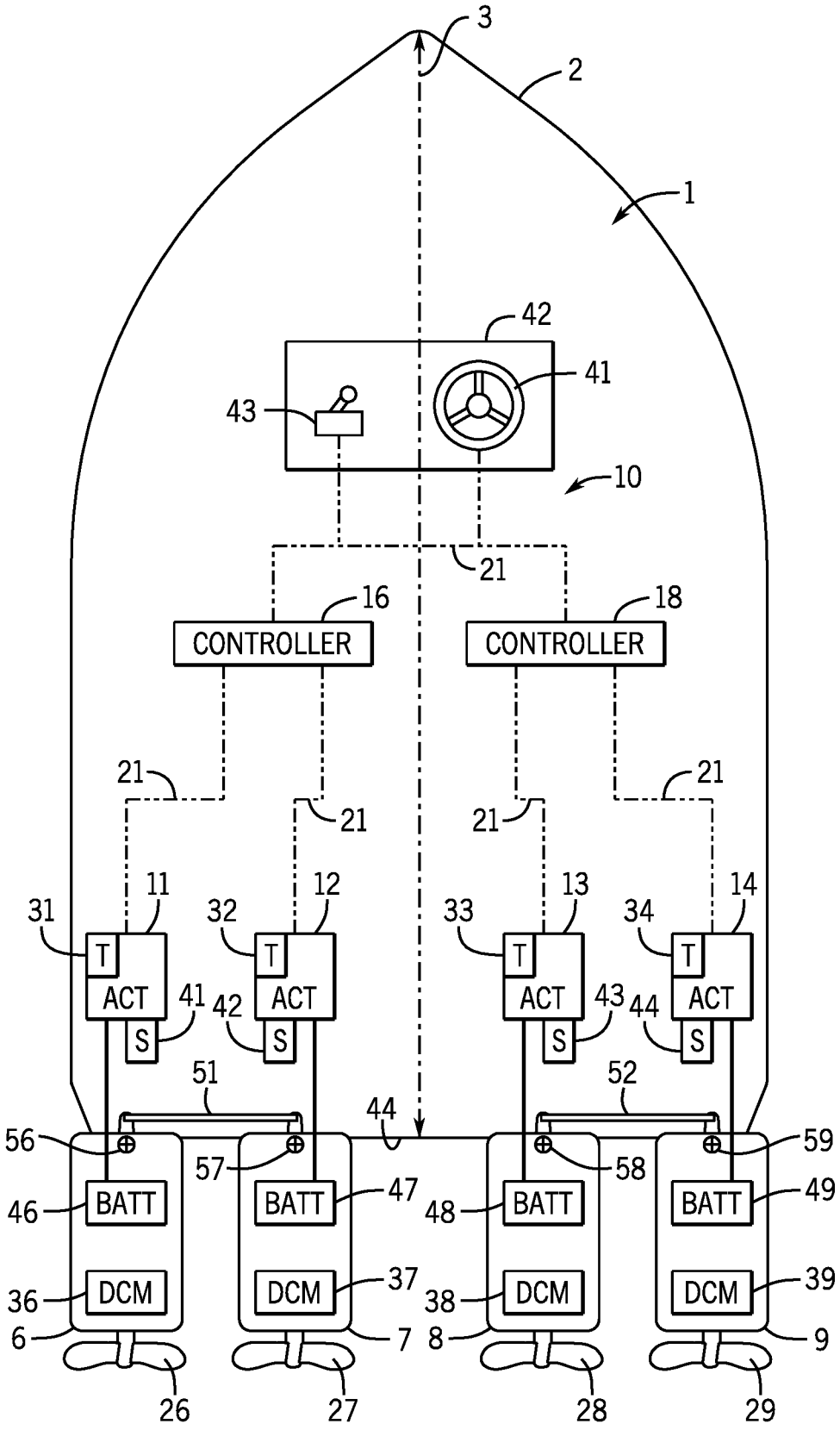
FIG. 1 illustrates a marine vessel having an exemplary marine propulsion system including two sets of mechanically linked marine drives and a steering control system according to one embodiment of the present disclosure.

Providing mechanical linkages between steerable drives, particularly steerable outboard drives, is advantageous because the mechanical link, such as a tie bar, provides load cancellation and balancing, as well as force damping effects. Typically, mechanically linked drives are steered with a single actuator, since the linked drives are steered in parallel and cannot be separately steered by varying angles or steered in opposite directions from one another. However, while the use of tie bars and other mechanical linking devices has significant advantages, the present inventors have recognized a problem with prior art systems for steering mechanically linked drives (e.g., outboard drives connected by a tie bar) that the steering forces can overwhelm the single actuator driving the tied drives. Particularly where drives are configured with the same propeller rotation, the steering loads are often additive and thus can more easily overwhelm the capabilities of the single actuator. Furthermore, in many different tie bar configurations, the steering load of moving both tied drives with a single actuator can exceed the load carrying capability of the actuator, which is determined by a combination of things, including a current limit of the actuation device, the load carrying design limitation of the midsection component, the mechanical limit in the steering linkage mechanism, the bolted joint limitation at the steering actuator interface, and other packaging and component load-bearing constraints. Thus, inventors have recognized that simply providing a bigger actuator with increased load capabilities is not the desired solution because it requires substantial reengineering of the drive arrangement.

The inventors have recognized the desirability of a solution that does not require adjusting the design of the drive midsection, steering linkage, actuator interface, or other packaging or steering system components to increase load-bearing capabilities. Furthermore, the inventors realized challenges with providing a plurality of steering actuators for steering mechanically linked drives. The inventors recognized that independently commanding the steering of each drive to a setpoint leads to inefficient and sometimes ineffective steering. For example, compliance and backlash in the system (including the actuation system and/or the mechanical linkage arrangement) and/or alignment issues may cause the actuators to fight each other. Resonance issues or a steady state offset situation may arise where each actuator is trying to correct the drive position based on its own steering position feedback and thus each actuator is continually pulling against the other.

In view of the foregoing problems and challenges in the relevant art, the inventors developed the disclosed system and method wherein a plurality of actuators are configured to work together, cooperatively, to steer the mechanically linked drives in parallel. A plurality of actuators are synchronized and cooperate to steer a plurality of linked marine drives based on steering position feedback provided by a single position sensor. A primary actuator may be designated, being the actuator associated with the steering position sensor used to provide steering position feedback for the system, and the remaining one or more actuator(s) are secondary steering actuator(s). The plurality of actuators are then controlled accordingly. In one embodiment, a first steering instruction is determined for the primary steering actuator based on a steering command, such as from a steering wheel or joystick, and the current steering position such that the first steering actuator bears a first portion of a total steering load to effectuate the steering command. A coordinated steering instruction is determined for the at least one secondary steering actuator such that the secondary steering actuator(s) bears a remaining portion of the total steering load.

In certain embodiments described herein, the coordinated steering instruction is the same as the first steering instruction such that the first steering actuator and the second steering actuator each bear half of the total steering load. In other embodiments described herein, the coordinated steering instruction is based on the first steering instruction such that the secondary steering actuator effectuates the remaining portion of the total steering load not born by the first steering actuator. For example, the first steering instruction may be based on one or more of a load capability of the first steering actuator, temperature of at least one of the first steering actuator and the second steering actuator, a charge level or state of health of at least one of a first battery associated with the first steering actuator and a second battery associated with the second steering actuator, and a fault status of at least one of the first steering actuator and the second steering actuator.

In certain examples, the steering instructions to the various steering actuators may be transmitted at different times, depending on the transmission route of the instruction, such that the first steering instruction and the coordinated steering instruction arrive at their respective intended actuators substantially simultaneously. Such delays may be implemented in embodiments where the steering actuators are configured in an equal load sharing arrangement, and in embodiments where the primary and secondary actuators bear differing load amounts.

FIG. 1 illustrates an exemplary marine vessel 2 with a marine propulsion system 1 in accordance with the present disclosure. The exemplary marine propulsion system 1 includes four marine drives 6-9, which are outboard motors coupled to the transom 44 of the marine vessel 2. The marine drives 6-9 are attached to the vessel 2 in a conventional manner such that each drive 6-9 is rotatable about a respective vertical steering axis 56-59. In the depicted examples, the marine drives 6-9 are configured in two sets of two marine drives, one set on each side of the centerline 3 along the keel. Marine drives 6 and 7 comprise one set fixed to the port side of the stern 44 (port of the centerline 3), and marine drives 8 and 9 comprise the second set fixed to the starboard side of the stern 44. The first set of marine drives 6 and 7 include outer port drive 6 and inner port drive 7. The second set of marine drives 8 and 9 include inner starboard drive 8 and outer starboard drive 9.

Other embodiments may include any number of two or more drives that are mechanically linked, which may be linked in sets of two, three, or more. The drives may be configured in two or more sets evenly distributed around the centerline 3. For example, a marine propulsion system 1 having eight drives may be configured in two sets of four drives or four sets of two drives. Likewise, the marine propulsion system 1 may have two sets of three drives, for a total of six. In the embodiments depicted in the FIGURES, the marine drives are outboard motors; however, a person having ordinary skill in the art will understand in view of this disclosure that in other embodiments the marine drives 6-9 may be inboard/outboard motors or stern drives mechanically connected together and controlled in the same arrangements as is depicted and described with respect to the FIGURES.

Each marine drive 6-9 includes a powerhead (not shown) configured to drive rotation of a propulsor 26-29. Each powerhead may be, for example, an electric motor or an internal combustion engine. Each drive includes a drive control module (DCM) 36-39 configured to control operation of the powerhead, such as rotational speed and/or output thereof, among other aspects and systems on or associated with the respective marine drive 6-9. Each marine drive 6-9 may also have an associated battery 46-49, such as a lead-acid battery, lithium-ion battery, or the like. The batteries 46-49 are configured to power electrical systems on or associated with each respective marine drive 6-9, including the steering actuators 11-14. In certain embodiments, the battery may include or be associated with a battery controller configured to monitor a charge level, such as battery voltage and/or state of charge, as well as a battery state of health. The battery controller (not shown) may be configured to communicate such values to the DCM 36-39 and/or directly to one or more controllers (e.g., 16, 18) in the steering control system 10.

Each set of marine drives 6-7, 8-9 is connected together with a mechanical link 51, 52. In one example, the mechanical link is an adjustable tie bar, such as those exemplified and described in U.S. Pat. No. 6,913,497 or 8,512,085; however, a person having ordinary skill in the art will understand in view of this disclosure that any mechanical link arrangement between drives configured to enable load cancellation and sharing are appropriate. Mechanical link 51 connects the port inner marine drive 7 to the port outer marine drive 6. Likewise, the mechanical link 52 connects the inner starboard marine drive 8 to the outer starboard marine drive 9.

The mechanical links 51, 52 maintain a set distance between the inner and outer marine drives in each set such that as one drive turns, the other drive in the set also turns in the same direction and by a substantially equal amount. As is expected, there will be some amount of compliance and/or backlash in the mechanical linkage arrangement where the movement of the mechanically linked drives is not precisely the same, and the system may be configured to account for such compliance and/or backlash. Additionally, the drives may be mechanically linked together at angles other than parallel, such as tied in a toe in or toe out arrangement. Regardless of insignificant differences in steering due to compliance or backlash of the mechanical linkages, and/or differences in alignment of the drives in the tied arrangement, it is considered that the mechanically linked drives of each set are steered together in parallel about their respective steering axes.

The steering control system 10 is configured to steer each of the marine drives 6-9 in the propulsion system 1, such as including one steer-by-wire steering actuator 11-14 for each drive, in response to steering commands. Each steer-by-wire steering actuator 11-14 may be any of various types of actuators, including hydraulic over electric actuators, pure electric actuators, direct driven hydraulic actuators, or any other steer-by-wire technology. Each steer-by-wire steering actuator is configured to move its respective marine drive 6-9 about its steering axis 56-59 in response to the steering command, which may be based on manipulation of an input device at the helm 42, such as steering wheel 41 or joystick 43, or from a navigation control module configured to automatically generate steering commands (such as waypoint navigation, station keeping, or other autonomous navigation functionality).

Each steering actuator 11-14 is configured and controllable to steer a respective one of the marine drives 6-9. However, the steering control system 10 is configured such that the steering actuators 11-14 are controlled in pairs based on the mechanical linking arrangement of the marine drives 6-9. Thus, in the depicted example, control of a first set of steering actuators 11 and 12 are coordinated together to steer the first set of marine drives 6 and 7 in parallel, and a second set of steering actuators 13 and 14 are coordinated together to steer the second set of marine drives 8 and 9 in parallel. The two sets of actuators and marine drives may be steered independently of one another to different steering angles, but within each set steering remains parallel.

Additionally, a person having ordinary skill in the art will recognize in view of the present disclosure that the steering control methods and systems described herein may apply equally to a propulsion system 1 having only one set of marine drives, and the set may include any number of two or more drives connected together by one or more mechanical link(s) such that steering can be enacted by a single steering actuator.

Equipping a marine vessel 2 with four drives provides increased propulsion power allowing for high speeds of travel, including upwards of 65 MPH or 90 MPH or higher, and/or for propelling heavy vessels 2. The sets of marine drives 6 and 7, 8 and 9 are capable of being steered separately to different angles, or both sets may be steered together in parallel. This allows the marine drives 6-9 to operate in many different modes, including in a joystick mode such as that described in U.S. Pat. No. 7,467,595 incorporated by reference herein above. While in joystick mode, each steer-by-wire steering actuator 11-14 may rotate an associated one of the marine drives 6-9. In an alternative arrangement, a vessel provided with four or more drives have all four drives tied together, such as with a combination of tie bars and hydraulic hoses and actuators, so that all engines work and steer in unison. In such embodiments the steering control system 10 is configured to coordinate steering of all four steering actuators 11-14 together, such as in an arrangement where one of the four actuators is designated as the primary and all others are designated as secondary.

In the depicted example, a steering position sensor 41-44 is associated with each steering actuator 11-14 and configured to measure a steering position of the respective marine drive 6-9. The steering position sensor 41-44 may, for example, be configured to measure an actual rotational position of the drive as it is rotated about its steering axis 56-59, or may be configured to measure a position of a movable portion of the actuator 11-14, such as a position of one or more hydraulic pistons. The position measurement by each steering position sensor 41-44 is available as feedback to the steering control system 10; however, only the position feedback associated with the primary steering actuator for each set may be utilized by the steering control algorithm. In certain embodiments where one steering actuator is configured as the permanent primary actuator and the role does not shift to other actuators, the system may be configured such that only the primary steering actuator(s) have a position sensor associated therewith.

In some embodiments, each steering actuator 11-14 may also have a temperature sensor 31-34 associated therewith configured to measure a temperature of the actuator 11-14. As actuators are operated, particularly if operated toward the top end of their load bearing capabilities and/or operated for extended periods, the actuator may heat up and may even overheat if continually operated under such conditions. Thus, the steering control system 10 may be configured to consider the temperature of each actuator 11-14 when apportioning steering loads to avoid overheating any one or subset of actuators due to over-exertion.

The steering control system 10 includes one or more controllers 16, 18 configured to control the steering actuators 11-14. The controllers 16, 18 are provided with programming that executes the steering control methods to effectuate coordinated control of actuator sets as described herein. The steering control system 10 may include one controller to execute all steering functionality, or may include multiple controllers communicatively connected and configured to cooperate for execution of steering control. In certain embodiments, one steering lead controller 16, 18 may be provided for each set of actuators 11-12, 13-14 and configured to determine a steering instruction for the primary actuator and a coordinated steering instruction for the secondary actuator(s). The steering control system 10 may include additional controllers configured to perform portions of the steering control functionality, such as to provide information to the corresponding steering lead controller 16, 18 and/or to receive and effectuate commands from the steering lead controller 16, 18.

Figure 2A:
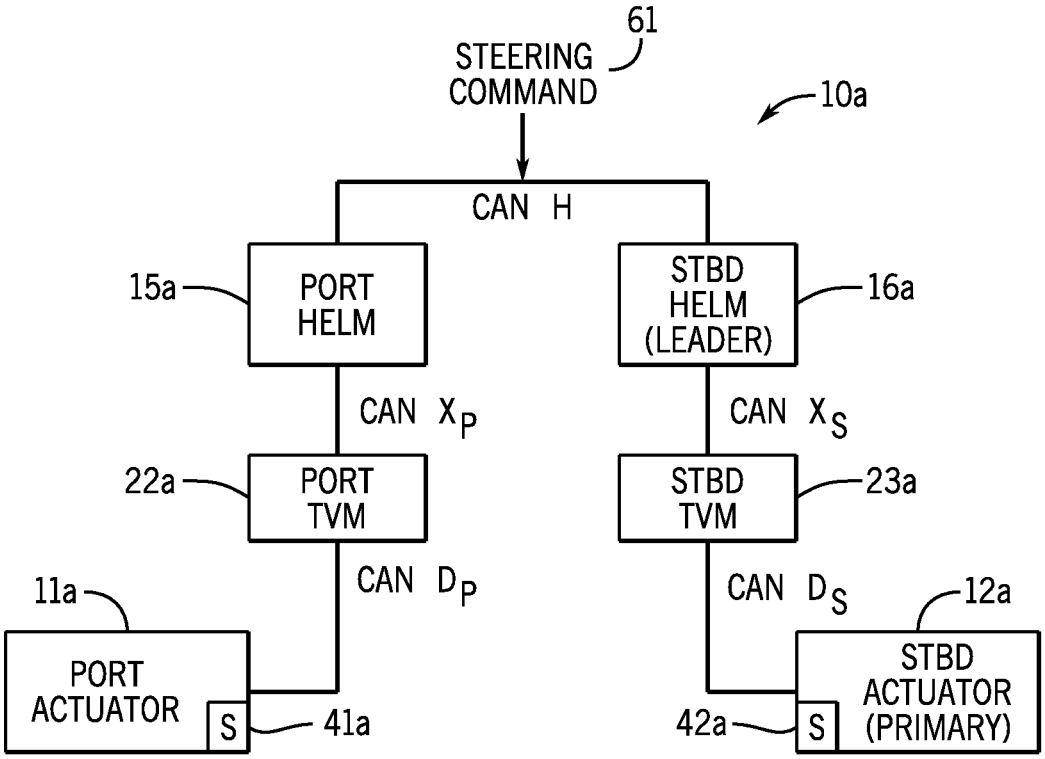
FIGS. 2A and 2B each illustrate an embodiment of a steering control system.
Figure 2B:
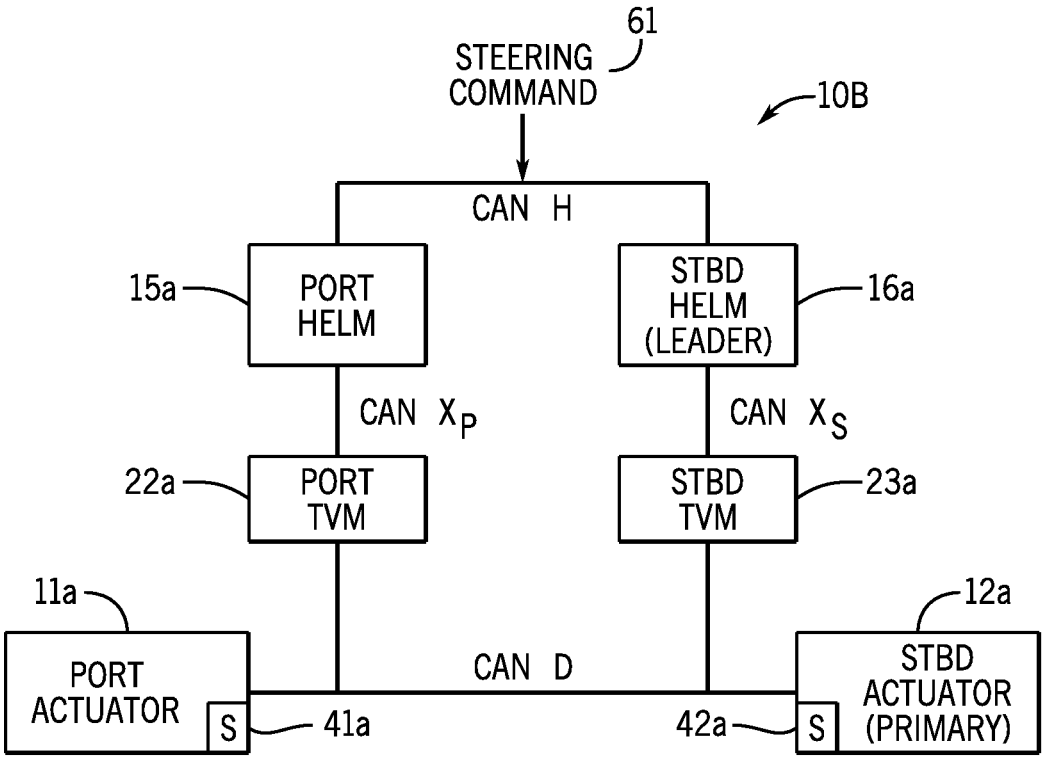

FIGS. 2A and 2B depict additional exemplary steering control system 10*a*, 10*b* arrangements associated with one set of actuators 11*a*-12*a* configured to steer a set of mechanically linked drives in parallel. In each of these examples, the control system 10*a*, 10*b* includes a helm control module (HCM) 15*a*, 16*a* for each drive and thus each actuator 11*a*, 12*a*. For purposes of convenience of reference, the set is described with reference to port side and starboard side elements. It should be understood that this may illustrate a full control arrangement for a propulsion system 1 having a two linked marine drives, or may illustrate a control arrangement for one set of drives and actuators, and that the depicted control arrangement may be repeated for each set of mechanically linked drives in the propulsion system 1. Thus, for the exemplary system in FIG. 1 having two sets of two linked drives, the arrangement in either one of FIG. 2A or 2B may be doubled such that there is one set of controllers (e.g., HCM and TVM) for each marine drive 6-9.

Each helm control module 15*a*, 16*a* receives steering commands 61, such as from movement of the steering wheel 41, joystick 43, or other user input device configured for user control of steering. Alternatively, the steering commands 61 may be by a navigation controller configured for autonomous steering control. One controller in the steering control system 10*a*, 10*b* may be designated as the steering leader, which in the depicted example is the starboard HCM 16*a*. The steering leader controller is programmed to determine at least the first steering instruction based on the steering command 61 and the current steering position of the primary actuator. In these examples the starboard actuator 12*a* is designated as the primary actuator and thus the position measurements from the steering position sensor 42*a* associated with the starboard actuator 12*a* is utilized to provide position feedback.

The steering lead controller 16*a* determines the first steering instruction, such as based on one or more of load capabilities of at least one of the steering actuators 11*a*, 12*a*, temperatures of at least one of the steering actuators 11*a*, 12*a*, charge levels or states of health of at least one of a the batteries (e.g. 46, 47) associated with the actuators 11*a*, 12*a*, and a fault status of at least one of the steering actuators 11*a*, 12*a*.

The first steering instruction is calculated such that the primary steering actuator 12*a* bears a portion of the total steering load to effectuate the steering command. A coordinated steering instruction is determined for the secondary steering actuator 11*b*, and likewise for each additional secondary steering actuator in the set (if any) such that the remaining portion of the total steering load is apportioned to the secondary steering actuator(s). The steering instructions are then communicated to each actuator 11*a*, 12*a* through the control system 10. In the depicted example, the steering instructions are transmitted to the steering actuators 11*a*, 12*a* via one or more of the TVMs 22*a*, 23*a*.

The system 10 may be configured such that the primary steering actuator bears all or a substantial portion of the load until one or more system constraints, such as load capability, actuator temperature, battery charge level, etc. indicates that the primary actuator may not be sufficient to execute the steering command on its own or doing so will overtax the primary actuator (such as exceed a load threshold or cause the actuator temperature to exceed a temperature threshold). Such information, such as battery charge level, actuator temperatures, measured steering position of the primary actuator, etc. may be provided to the steering leader controller 16*a* via the respective local controller, illustrated here as the thrust vector module (TVM) 22*a*, 23*a* for each actuator 11*a*, 12*a* and corresponding marine drive. The system 10 may be configured to calculate the first steering instruction such that the primary steering actuator remains within certain temperature and load constraints, for example, and may control the secondary actuator(s) 11*a* to bear the remaining portion of the total steering load. The coordinated steering instruction is then calculated for each secondary actuator 11*a*, which may be by the steering leader controller

16*a* or by the respective TVMs 22*a* for the secondary actuator 11*a* (or any other controller in the system 10), based on the remaining portion of the total load.

Alternatively or additionally, the system 10 may be configured to apportion the total steering load substantially evenly between the actuators 11*a*, 12*a*. For example, the steering leader controller 16*a* may be configured to determine the same steering instruction for each actuator such that each bears half of the total steering load, and thus the first steering instruction and the coordinated steering instruction are substantially the same. In certain embodiments, the control system may be configured to selective deploy different steering load apportionment strategies depending on the system constraints, such as those described above. For example, the system 10 may be configured to deploy an equal apportionment strategy when the steering system and associated components are within normal operating ranges, and to employ selective load apportionment when one or more of the system constraints are exceeded (e.g., load thresholds, temperature thresholds, battery charge level thresholds, battery state of health thresholds, an actuator fault condition is generated, etc.).

In the instance of a malfunction or fault status of one of the steering actuators 11*a*, 12*a*, the respective TVM 22*a*, 23*a* will detect and communicate (directly or indirectly) the steering fault status to the steering leader HCM 16*a*. For example, a steering fault status may arise if the steering actuator 11*a*, 12*a* is unable to effectuate the steering command, such as not having the ability to provide the force necessary to execute the command, or if the steering actuator 11*a*, 12*a* fails altogether and can no longer operate. Depending on the cause or content of the communicated steering fault status, the steering leader controller 16*a* may adjust the command strategy accordingly. For example, if the steering fault status relates to insufficient steering force output of the primary actuator, then the steering leader controller 16*a* may command that secondary steering actuator 12*a* increase its output. If the steering fault status relates to a failure condition of one of the steering actuators 11*a*, 12*a*, then steering leader controller 16*a* may adjust their steering algorithm to shift as much of the steering load as possible to the actuator that is functioning normally. The TVM 22*a*, 23*a* may also determine the functioning state of its associated marine drives 6 and 7, 8 and 9 by communication with the respective DCM 36-39. For example, the TVM 22, 23 may receive the engine rpm of each of its respective drives from the DCMs 36 and 37, 38 and 39.

Each controller (HCM, TVM, DCM, etc.) may include a computing system that includes a processing system, storage system, software, and input/output (I/O) interfaces for communicating with other devices, including the steering input devices at the helm 42, steering actuators 11-14, and marine drives 6-9. The processing system loads and executes software from the storage system, including a software application module to control steering operations and the steering actuator. When executed by the computing system, the actuator control software application module directs the processing system to operate as described herein below in further detail to execute the method of controlling steering. While each HCM, TVM, and DCM is discussed herein as a single processing unit, one of ordinary skill in the relevant art will understand in view of the present disclosure that each HCM, TVM, and DCM may include one or many application modules and one or more processors, which may be communicatively connected. The processing system can comprise a microprocessor and other circuitry that retrieves and executes software from the storage system. Processing system can be implemented within a single processing device but can also be distributed across multiple processing devices or sub-systems that cooperate in executing program instructions. Non-limiting examples of the HCM, TVM, and DCM include general purpose central processing units, application specific processors, and logic devices.

In one embodiment, each controller within the control system 10 is connected by one or more communication links 21, which may be by any wired or wireless communication means and standard. For example, the communication links 21 may be by one or more controller area network (CAN bus). FIGS. 2A and 2B illustrate exemplary CAN bus arrangements for the steering control system 10*a*. In both configurations, the HCMs 15*a* and 16*a* are connected by a first CAN bus, referred to as CAN H. A steering command 61 is transmitted via CAN H to both HCMs 15*a*, 16*a*. For example, the steering command may be received from sensors associated with the steering wheel 41 or the joystick 43 providing a user-inputted steering command. Alternatively, the steering command 61 may be from a navigation controller executing an autonomous navigation program that generates a steering command, such as a station keeping control program or a waypoint navigation program.

Each of the HCMs 15*a*, 16*a* is connected to a respective TVM 22*a*, 23*a* via a respective dedicated CAN bus, where the port HCM 15*a* is connected to the port TVM 22*a* via CAN Xp. The starboard HCM 16*a* is connected to the starboard TVM 23*a* by CAN Xs. Each TVM 22*a*, 23*a* also has a dedicated CAN bus connecting it to its respective actuator and marine drive, where the port TVM 22*a* communicates to the port actuator 11*a* via CAN Dp and the starboard TVM 23*a* communicates to the starboard actuator 12*a* via CAN Ds. The steering position sensors 41*a* and 42*a* may also be configured to communicate on the respective CAN D bus, or may be configured to communicate with the respective TVM 22*a*, 23*a* via a dedicated bus (not shown) connecting between each actuator 11*a*, 12*a*, and its respective TVM 22*a*, 23*a*.

Once calculated, the steering instructions are each transmitted to the steering actuators 11*a*, 12*a*, which in the depicted examples is from the steering lead controller 16*a* through the respective TVMs 22*a*, 23*a* to the actuators 11*a*, 12*a*. Each message and receipt at each intervening controller adds a delay to the message transmission. Thus, the coordinated steering instruction sent to the secondary actuator 11*a*, may be delayed compared to transmission of the first steering instruction because the message is relayed through at least one additional controller compared to the instruction to the primary steering actuator 12*a*. Here, the coordinated steering instruction is transmitted from the starboard HCM 16*a*, designated as the steering leader controller, to the port HCM 15*a*, which transmits the instruction to the port TVM 22*a*, which transmits the instruction to the port actuator 11*a* assigned as the secondary actuator. Thus, the coordinated steering instruction has more receipt/transmission actions than the first steering instruction and thus will take longer to reach the secondary actuator.

To address and mitigate this delay, the control system 10, and particularly the steering leader controller 16*a*, may be configured to provide a transmission delay time between the coordinated steering instruction sent to the secondary actuator 11*a* and the steering instruction sent to the primary steering actuator 12*a*. The starboard HCM 16*a* may be configured to send the coordinated steering instruction of the primary steering instruction by approximately the amount of time it takes for the message to be transmitted to and received by the port HCM 15*a*, which accounts for the extra transmission/receipt steps compared to the path of the first steering instruction to the primary actuator. The starboard HCM 16*a* may then transmit a first steering instruction to the starboard TVM 23*a* after the delay time, which then transmits the instruction to the starboard actuator 12*a*. The transmission of the steering instructions to the TVMs 22*a*, 23*a* are thus transmitted substantially simultaneously such that the steering actuators 11*a*, 12*a* are instructed to move substantially simultaneously, such as within several milliseconds of one another.

FIG. 2B depicts an arrangement of CAN buses wherein each TVM 22*a*, 23*a* is configured to communicate with both actuators 11*a*, 12*a*. This communication arrangement eliminates the communication delay issue described above with respect to the CAN bus arrangement in FIG. 2A because steering instructions can be sent from either TVM 22*a*, 23*a* to both of the steering actuators 11*a*, 12*a* such that the steering instructions are received substantially simultaneously at both of the actuators. In such an arrangement, the starboard HCM 16*a*, configured as the steering leader controller, may communicate the first steering instruction and the coordinated steering instruction through the starboard TVM 23*a*, which then communicates the steering instructions to the port and starboard actuators 11*a* and 12*a* via CAN D. The steering position sensors 41*a* and 42*a* may both be configured to communicate the respective sensed positions via CAN D. Alternatively, an additional dedicated CAN bus may exist between each of the TVMs 22*a*, 23*a* and its respective actuator 11*a*, 12*a* in addition to CAN D. Likewise, redundant CAN buses may be provided for more of the sections of the control system 10. Alternatively or additionally, additional communication links may cross-communicate between the port and starboard sides. For example, an additional communication link, such as a CAN bus, may be provided between the port and starboard HCMs 15*a*, 16*a* and both the port and starboard TVMs 22*a*, 23*a*, for example, so that the steering leader controller 16*a* can communicate to both of the TVMs 22*a*, 23*a*, simultaneously.

Figure 3:
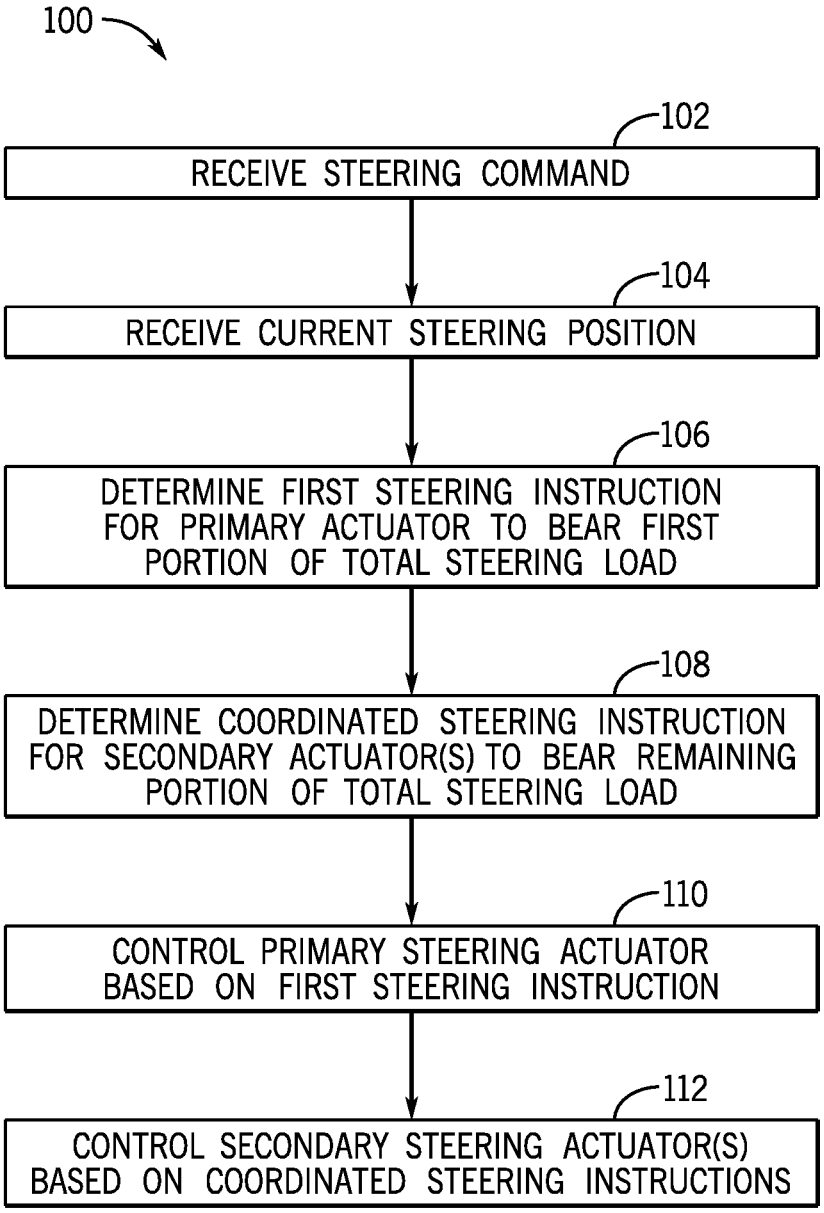
FIGS. 3-7 depict exemplary embodiments of a steering control method, or portions thereof, of steering a plurality of mechanically linked drives in parallel according to the present disclosure.

FIG. 3 depicts one embodiment of a method 100 for controlling steering of a set of marine drives that are connected by a mechanical link. As described above, the steering control methods and systems provided herein may apply equally to a propulsion system 1 having only one set of marine drives as to a propulsion system 1 having multiple sets of marine drives. Each set of marine drives may include two, three, or more drives that are mechanically linked together, such as with a tie bar. FIGS. 4-7 depict additional embodiments of a steering control method 100, or portions thereof, providing further examples and explanation regarding the disclosed methods of steering mechanically linked marine drives with a plurality of steering actuators.

In the embodiment illustrated in FIG. 3, a steering command is received at step 102, such as via a user input device at the helm 42 or from a navigation controller, as described above. A current steering position is received at step 104, such as measured by the steering position sensor associated with the primary steering actuator. A first steering instruction is then determined for the primary actuator based on the steering command and the current steering position at step 106, such that the primary steering actuator is a first portion of the total steering load. A coordinated steering instruction is determined for the remaining one or more secondary steering actuators at step 108 such that the one or more secondary steering actuators bear the remaining portion of the total steering load. The primary steering actuator is controlled based on the first steering instruction at step 110 and the secondary steering actuator(s) is/are controlled at step 112 based on the coordinated steering instruction(s).

The steering instructions may include a target steering position as well as a duty cycle command or other command and control the output magnitude of the force exerted by the respective steering actuator. Likewise, the steering load may be represented in a similar way as the steering instructions such that the steering instructions can be determined based on the load. For example, steering load may be represented as the actuator's current consumption or measured by a force transducer or load cell. Where the steering actuator is a hydraulic actuator, steering load may be represented as fluid pressure in the actuator(s).

In some embodiments, the steering control system 10 may be configured to designate one steering actuator in the set of steering actuators as the primary steering actuator and the remaining steering actuators in the set being the secondary steering actuator(s). For example, with reference to FIGS. 2A and 2B, the steering lead controller 16*a* will be configured to designate either one of the port actuator 11*a* or the starboard actuator 12*a* as the primary steering actuator. In various embodiments, designation of the primary steering actuator may be based on at least one of an alternation routine, a temperature of the first steering actuator (e.g. 11*a*) and/or a temperature of the second steering actuator (e.g. 12*a*), a battery charge level of a first battery associated with the first steering actuator and/or a battery charged level of a second battery associated with the second steering actuator, and a full status of either the first or second actuators.

Figure 4:
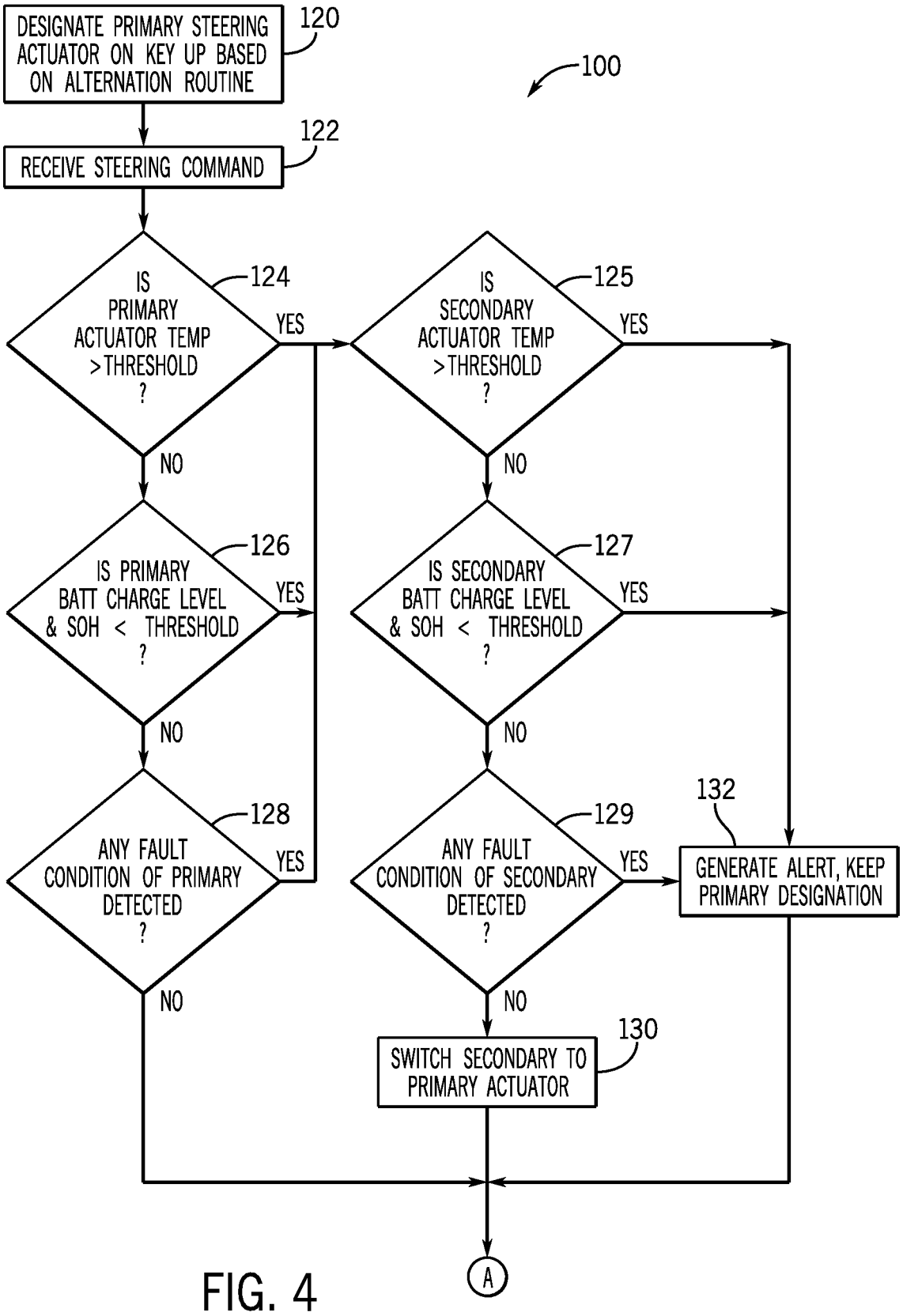

FIG. 4 depicts an exemplary set of method steps for selecting the primary actuator. At step 120, the primary steering actuator is initially designated at key-up based on an alteration routine. The alteration routine is stored, for example, in the steering lead controller 16*a*, and configured to distribute the role of primary steering actuator between the eligible steering actuators and the set—i.e., those steering actuators that have an associated and operating steering position sensor. For example, the alternation routine may be configured to alternate between the first steering actuator and the second steering actuator as the primary steering actuator, changing the designation at each key-up. Thereby, the role of primary steering actuator, which may put additional load on that actuator, is rotated throughout the actuators in the system. As another example, the alternation routine may be based on run hours, where each actuator is designated as the primary steering actuator for a predetermined number of run hours and then the role is changed to another steering actuator. A person of ordinary skill in the art will understand in view of the present disclosure that other alternation routines are possible such the primary steering actuator role is distributed evenly along the plurality of actuators in each set.

A steering command is received at step 122, such as from a user input device at the helm 42 or from a navigation controller, as described above. A routine is then executed to determine whether the role of primary steering actuator should be switched to another actuator in the system, such as based on temperature, battery values, or detection of a fault condition. Step 124 is executed to determine whether the primary actuator temperature is greater than a threshold temperature. Instructions are executed at step 126 to assess whether the battery associated with the primary actuator has a low charge level or poor state of health. If not, then steps are executed to confirm that no fault condition is detected for the primary actuator, represented at step 128.

If none of those conditions are true, then the role of primary steering actuator is maintained and steps are executed to determine a steering instruction for each of the actuators by one of the various methods described herein. If any of the conditions at steps 124-128 are true, then steps are executed to assess the temperature, battery values, and fault condition of each of the one or more secondary actuators in the set until a suitable actuator is located to fill the role of primary steering actuator. For example, instructions are executed at step 125 to determine whether the secondary actuator exceeds the temperature threshold, step 127 is executed to determine whether the battery associated with the secondary actuator has an adequate charge and state of health, and a fault check is performed at step 129 to assess whether the secondary actuator has generated a fault condition.

If one of the secondary actuators meets the temperature, battery, and fault status requirements, then it is designated as the primary actuator at step 130 and the previous primary actuator is moved to the role of secondary actuator. If none of the steering actuators meets the temperature, battery, and fault status requirements, an alert is generated at step 132, which will advise the user of the steering actuator issue and the primary steering actuator designation is maintained. In certain embodiments, the system will enter a guardian mode where limits on steering and/or vessel speed are enacted to reduce/limit stress on the steering actuation system.

In embodiments where the role of primary steering actuator is rotated between a plurality actuators in the set, each steering actuator is equipped with a steering position sensor and the steering position measurement from that sensor is utilized as position feedback for steering control when that actuator is designated as the primary steering actuator. In other embodiments, the role of primary steering actuator may be fixed such that a particular steering actuator is always the primary steering actuator. In such an embodiment, only the primary steering actuator may be equipped with a steering position sensor, which is always utilized to provide steering position measurements for steering control.

Figure 5:
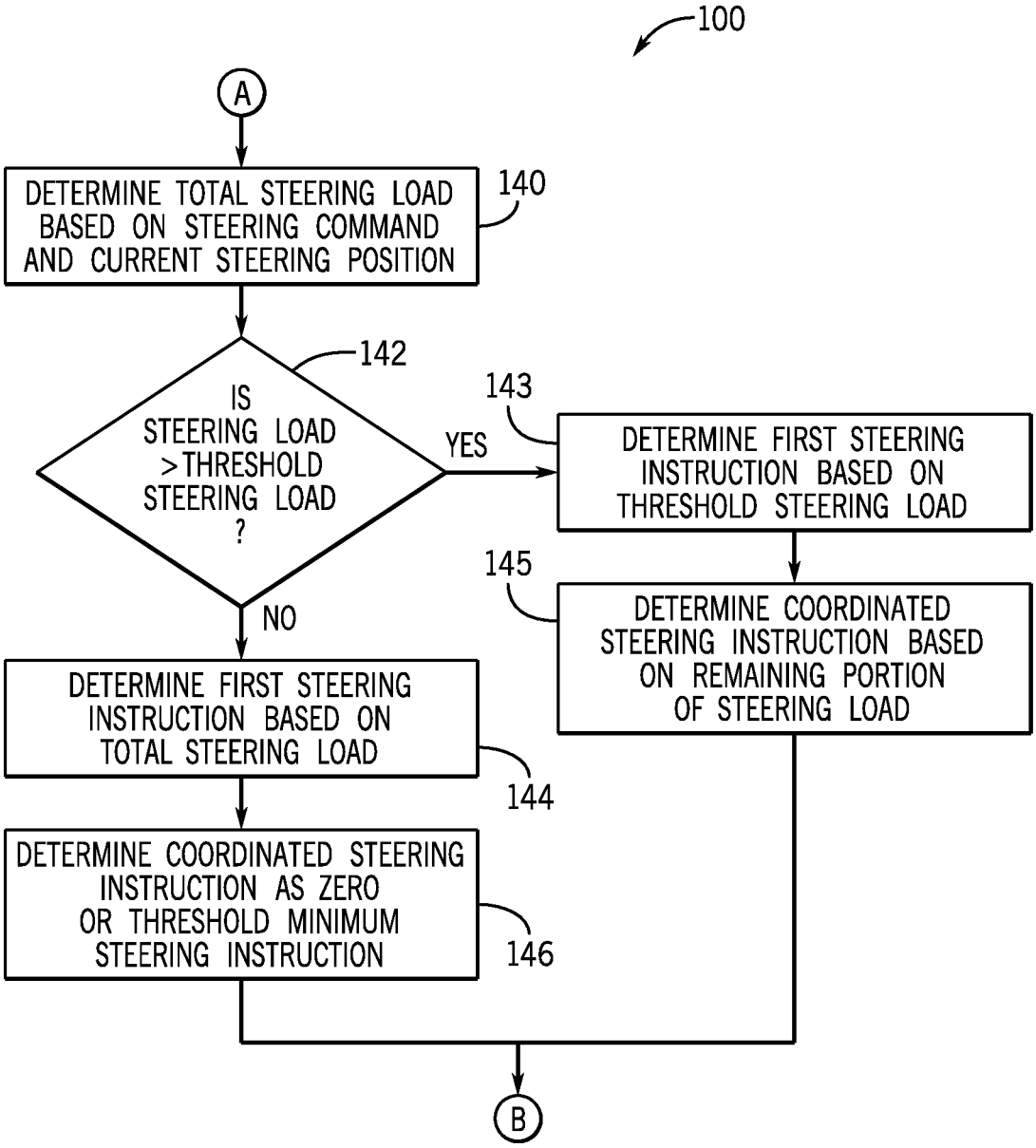

In certain embodiments, the first steering instruction for the primary steering actuator is determined based on a load capability and/or a load threshold, which may be set based on the load capability of the steering actuator. FIG. 5 depicts one such embodiment. The total steering load is determined at step 140 based on the steering command received and a current steering position. Total steering load represents a sum of the load measurements from each actuator on a tied set of engines to effectuate the steering command (e.g., total current, sensed force, actuator duty cycle, etc). If the steering load is greater than the threshold steering load, assessed at step 142, then it is determined that both of the steering actuators are needed for effectuating the steering command. The first steering instruction is determined at step 143 based on the threshold steering load such that the load borne by the primary actuator does not exceed the threshold. The coordinated steering instruction is determined at step 145 based on the remaining portion of the steering load not commanded to the primary steering actuator.

If the total steering load does not exceed the threshold steering load at step 142, then the primary steering actuator may be utilized to bear all or most of the steering load. The first steering instruction is determined at step 144 based on the total steering load, such as to effectuate the steering command only using the primary steering actuator. The coordinated steering instruction is then determined at step 146, which may be determined to be zero when the secondary steering actuator does not participate.

In certain embodiments, instead of a secondary steering actuator not engaging at all, the secondary steering actuator may instead be configured to generate at least a threshold minimum steering commanded by a threshold minimum steering instruction. For example, the threshold minimum steering instruction may be configured to compensate for at least a portion of the back driving force of the secondary steering actuator such that the primary steering actuator does not need to overcome the internal forces of the non-operating secondary steering actuator but would oppose the steering movement determined by the primary steering actuator. Once the primary and coordinated steering instructions are determined, the primary and secondary steering actuators are controlled accordingly, such as illustrated in FIG. 3 and/or in accordance with the embodiment depicted in FIG. 7.

Figure 6:
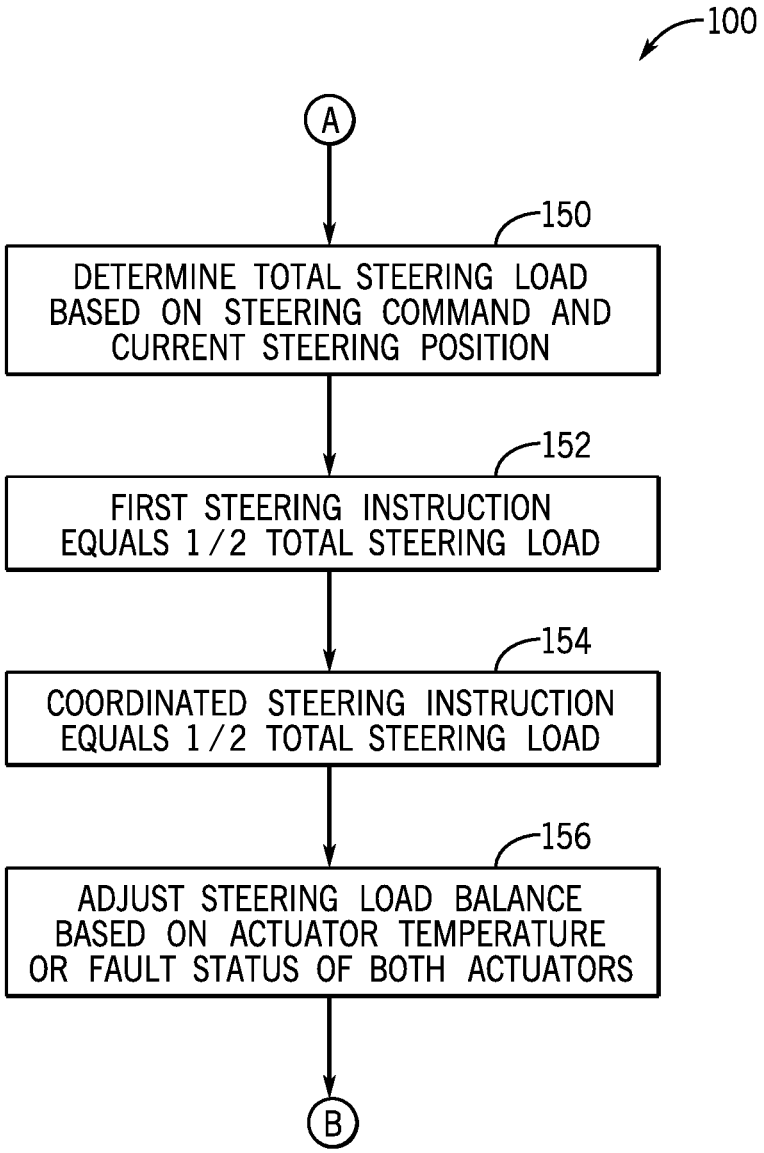

FIG. 6 depicts an alternative embodiment for calculating the first and coordinated steering instructions. The total steering load is determined at step 150 based on the steering command and the current steering position, similar to step 140 described above. The total steering load is then split between the first steering instruction and the coordinated steering instruction, where the first steering instruction is set based on half of the total steering load at step 152 and the coordinated steering instruction is set based on half of the total steering load at step 154. In certain embodiments, the control system 10 may be configured to adjust the steering load distribution based on various factors, such as actuator temperature, fault status, battery values, or the like. For example, the steering load distribution may be adjusted at step 156 if one of the actuators has generated a fault condition. There, the steering load of the faulted actuator may be decreased and the steering instruction of the remaining actuators in the set may be increased to compensate. Similarly, the steering load balance may be adjusted if a difference in the actuator temperatures of the respective actuators exceeds a threshold such that one actuator is significantly warmer than the other. The steering load of the warmer actuator may be decreased and that load shifted to the cooler actuator. Similarly, if a battery value for the battery of one actuator is significantly less than that of the others, an additional portion of the load will be shifted to the one or more actuator set with the stronger battery values.

Figure 7:
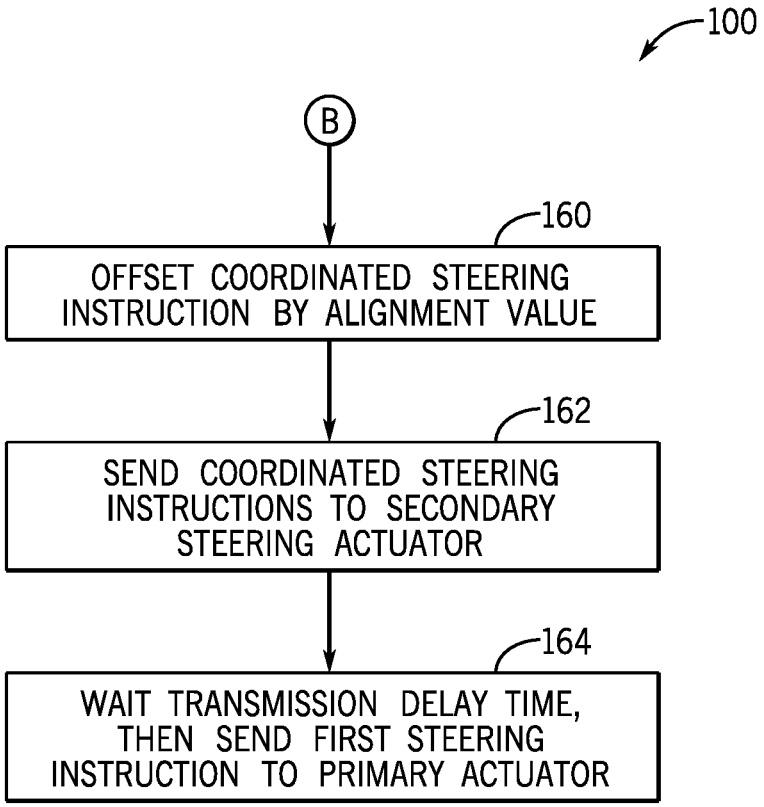

Alternatively or additionally, the control system 10 may be configured to adjust the steering commands to one or more of the actuators based on alignment of the drives, control system configuration and transmission delays, and/or compliance or backlash in the mechanical linkage tying the drives together. FIG. 7 depicts one such example. Once the first steering instruction and the coordinated steering instruction are determined, the values may be adjusted based on system constraints and configurations so that the marine drives are moved substantially in parallel and substantially simultaneously. At step 160, alignment imperfections of the marine drives are accounted for by offsetting the coordinated steering instruction by an alignment value. Due to intolerances, tie bar length, variation in drive housings, etc., the steering position sensors 41*a*, 42*a* associated with the actuators 11*a* and 12*a* most likely will not output the exact same steering position measurement at any given time, even though the marine drives are mounted and tied substantially in parallel. The system may be configured to store an alignment value to compensate for the differences in sensor measurements. For example, an alignment value can be obtained by operating each actuator to its respective end stop and measuring the steering position. The alignment value is the difference between the two measured values. The coordinated steering instruction can then be offset by the alignment value.

The system may be configured to delay transmission time of the one or more steering instructions based on the control system configuration such that the steering instructions arrive at each of the steering actuators substantially simultaneously. Various control system configurations are described herein, such as exemplified at FIGS. 2A and 2B, where the configuration of controllers and communication buses introduces differing transmission delay times for messages between the steering leader controller and each of the actuators 11*a*, 12*a*. As described above with respect to the example in FIG. 7, the coordinated steering instruction may be sent to the secondary steering actuator at step 162 ahead of the transmission of the first steering instruction. After a transmission delay time, then the first steering instruction is sent to the primary steering actuator at step 164.

Alternatively or additionally, the transmission delay time may be configured to account for backlash or compliance in the mechanical linkage arrangement, the drive housings, etc. In such an embodiment, the backlash-related delay can be determined using one actuator to back drive the other to its end stop where the measured steering positions of each actuator are stored. The primary actuator can then be operated to rotate the marine drives away from the end stop. Once the secondary actuator (the actuator that was being back driven) starts to move, the position of the primary actuator is noted. The difference between the two values is the delay due to system backlash. The transmission delay time may thus be configured to account for the backlash delay such that the commands for the secondary drive are transmitted ahead of the first steering instruction such that the secondary steering actuator is engaged within the backlash period of the system, thereby minimizing the interaction of the actuators.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A system for steering a marine vessel, the system comprising:

a first marine drive and a second marine drive connected by a mechanical link such that they are steered in parallel;

a first steering actuator configured to rotate the first marine drive about a first steering axis;

a first steering position sensor configured to measure a steering position of the first marine drive;

a second steering actuator configured to rotate the second marine drive about a second steering axis;

a control system configured to:

receive a steering command;

receive a current steering position from the first steering position sensor;

determine a first steering instruction for the first steering actuator based on the steering command and the current steering position such that the first steering actuator bears a first portion of a total steering load to effectuate the steering command, wherein the first steering instruction is determined based on at least one of a threshold steering load, a charge level or state of health of a first battery associated with the first steering actuator, and a temperature of the first steering actuator;

determine a coordinated steering instruction for the second steering actuator such that the second steering actuator bears a remaining portion of the total steering load; and control the first steering actuator based on the first steering instruction and the second steering actuator based on the coordinated steering instruction such that the first and second marine drives are steered in parallel about their respective steering axes.

2. The system of claim 1, wherein the coordinated steering instruction is based on the first steering instruction such that the second steering actuator effectuates the remaining portion of the total steering load not born by the first steering actuator.

3. The system of claim 2, wherein the first steering instruction is determined based further on a load capability of the first steering actuator.

4. The system of claim 2, wherein the first steering instruction is determined based further on the threshold steering load such that the remaining portion of the total steering load borne by the second steering actuator increases as the total steering load increases above the threshold steering load.

5. The system of claim 2, wherein the first steering instruction is determined based further on the charge level or state of health of a first battery associated with the first steering actuator such that the first portion of the total steering load is decreased when the charge level of the first battery is less than a threshold charge level or the state of health of the first battery is less than a threshold state of health.

6. The system of claim 2, wherein the first steering instruction is determined based further on the temperature of the first steering actuator such that the first portion of the total steering load is decreased when the temperature of the first steering actuator exceeds a threshold temperature or when the temperature of the first steering actuator exceeds a temperature of the second steering actuator by a threshold amount.

7. The system of claim 1, wherein the first steering instruction is determined based further on at least one of a load capability of the first steering actuator, temperature of at least one of the first steering actuator and the second steering actuator, a charge level or state of health of at least one of a first battery associated with the first steering actuator and a second battery associated with the second steering actuator, and a fault status of at least one of the first steering actuator and the second steering actuator.

8. The system of claim 1, wherein the coordinated steering instruction is the same as the first steering instruction such that the first steering actuator and the second steering actuator each bear half of the total steering load.

9. The system of claim 1, wherein the first steering instruction is transmitted to the first steering actuator at a different time than the coordinated steering instruction is transmitted to the second steering actuator such that the first and coordinated steering instructions arrive at the respective first and second steering actuators substantially simultaneously.

10. A system for steering a marine vessel, the system comprising:

a first marine drive and a second marine drive connected by a mechanical link such that they are steered in parallel;

a first steering actuator configured to rotate the first marine drive about a first steering axis;

a first steering position sensor configured to measure a steering position of the first marine drive;

a second steering actuator configured to rotate the second marine drive about a second steering axis;

a second steering position sensor configured to measure a steering position of the second marine drive;

a control system configured to:

designate one of the first steering actuator and the second steering actuator as a primary steering actuator and the other one of the first steering actuator and the second steering actuator as a secondary steering actuator;

receive a steering command;

receive a current steering position from the first steering position sensor if the first steering actuator is designated as the primary steering actuator and receive the current steering position from the second steering position sensor if the second steering actuator is designated as the primary steering actuator; and determine a first steering instruction for the primary steering actuator based on the steering command and the current steering position such that the primary steering actuator bears a first portion of a total steering load to effectuate the steering command;

determine a coordinated steering instruction for the secondary steering actuator such that the secondary steering actuator bears a remaining portion of the total steering load, wherein the coordinated steering instruction is greater than or equal to a threshold minimum steering instruction; and control the primary steering actuator based on the first steering instruction and the secondary steering actuator based on the coordinated steering instruction such that the first and second marine drives are steered in parallel about their respective steering axes.

11. The system of claim 10, wherein the threshold minimum steering instruction is configured to compensate for at least a portion of a backdriving force of the secondary steering actuator.

12. The system of claim 10, wherein the control system is configured to designate the primary steering actuator based on at least one of an alternation routine, a temperature of the first steering actuator and/or a temperature of the second steering actuator, a battery charge level of a first battery associated with the first steering actuator and/or battery charge level of a second battery associated with the second steering actuator, and a fault status of the primary actuator and/or a fault status of the secondary actuator.

13. The system of claim 12, wherein the alternation routine alternates the primary steering actuator between the first steering actuator and the second steering actuator.

14. A method of controlling at least two steering actuators on a marine vessel, wherein each of the at least two steering actuators are configured to steer a respective one of at least a first marine drive and a second marine drive that are connected by a mechanical link such that they are steered in parallel, the method comprising:

receiving a steering command;

receiving a current steering position from a steering position sensor configured to measure a steering position of the first marine drive or the second marine drive;

determining a first steering instruction for a primary steering actuator of the at least two steering actuators based on the steering command and the current steering position such that the primary steering actuator bears a first portion of a total steering load to effectuate the steering command, wherein the first steering instruction is determined based on at least one of a threshold steering load, a charge level or state of health of a first battery associated with the first steering actuator, and a temperature of the first steering actuator;

determining a coordinated steering instruction for a secondary steering actuator of the at least two steering actuators such that the secondary steering actuator bears a remaining portion of the total steering load; and controlling the primary steering actuator based on the first steering instruction and the secondary steering actuator based on the coordinated steering instruction such that the first and second marine drives are steered in parallel about their respective steering axes.

15. The method of claim 14, further comprising designating one of a first steering actuator and a second steering actuator of the at least two steering actuators as the primary steering actuator, and wherein the current steering position is received from the first steering position sensor if the first steering actuator is designated as the primary steering actuator and the current steering position is received from the second steering position sensor if the second steering actuator is designated as the primary steering actuator.

16. The method of claim 15, wherein the primary steering actuator is designated based on at least one of an alternation routine, a temperature comparison between a temperature of the first steering actuator and a temperature of the second steering actuator, a battery comparison between a battery charge level of a first battery associated with the first steering actuator and battery charge level of a second battery associated with the second steering actuator, and a comparison between a fault status of the first steering actuator and a fault status of the second steering actuator.

17. The method of claim 14, wherein the coordinated steering instruction is based on the first steering instruction such that the secondary steering actuator effectuates the remaining portion of the total steering load not born by the primary steering actuator.

18. The method of claim 17, wherein the first steering instruction is determined based further on at least two of a load capability of the primary steering actuator, the temperature of at least one of the primary steering actuator and the secondary steering actuator, the charge level or state of health of at least one of a first battery associated with the primary steering actuator and a second battery associated with the secondary steering actuator, and a fault status of at least one of the primary steering actuator and the secondary steering actuator.

19. The method of claim 17, wherein the first steering instruction is determined based further on the threshold steering load such that the remaining portion of the total steering load borne by the secondary steering actuator increases as the total steering load increases above the threshold steering load.

20. The method of claim 14, wherein the coordinated steering instruction is the same as the first steering instruction such that the primary steering actuator and the secondary steering actuator each bear half of the total steering load.

* * * * *